US005377845A

United States Patent [19]

Hämen et al.

[11] Patent Number: 5,377,845

[45] Date of Patent: Jan. 3, 1995

[54] METHOD OF SEPARATING PULP CONTAINING MAGNETIC CONSTITUENTS IN A WET-MAGNETIC, LOW-INTENSITY CONCURRENT SEPARATOR AND APPARATUS THEREFOR

[75] Inventors: Ilkka O. Hämen, Malmberget; Eskil Lindgren, Sala, both of Sweden

[73] Assignee: Sala International AB, Sala, Sweden

[21] Appl. No.: 889,957

[22] Filed: May 29, 1992

[30] Foreign Application Priority Data

Jun. 26, 1991 [SE] Sweden ..... 9101960.4

[51] Int. Cl.[6] ..... B03C 1/14

[52] U.S. Cl. ..... 209/223.2; 209/226; 209/232

[58] Field of Search ..... 209/39, 223.1, 223.2, 209/231, 232, 225, 226

[56] References Cited

U.S. PATENT DOCUMENTS

| | | | |
|---|---|---|---|
| 2,160,628 | 5/1939 | Steffensen | 209/223.2 X |
| 2,564,515 | 8/1951 | Vogel | 209/39 X |
| 2,607,478 | 8/1952 | Newton | 209/223.2 X |
| 2,675,918 | 4/1954 | Newton | 209/232 |
| 2,698,685 | 1/1955 | Newton | 209/223.1 |
| 2,945,590 | 7/1960 | Stearns | 209/223.1 |

FOREIGN PATENT DOCUMENTS

| | | | |
|---|---|---|---|
| 750727 | 1/1945 | Germany . | |
| 38777 | 10/1912 | Sweden . | |
| 198980 | 10/1965 | Sweden . | |
| 227295 | 1/1969 | Sweden . | |
| 1338893 | 9/1987 | U.S.S.R. | 209/223.2 |

*Primary Examiner*—D. Glenn Dayoan
*Assistant Examiner*—Tuan N. Nguyen
*Attorney, Agent, or Firm*—Burns, Doane, Swecker & Mathis

[57] ABSTRACT

A method which pertains to the separation of pulp which contains magnetic constituents in a wet-magnetic, low-intensity separator of the concurrent type, in which a cylindrical, horizontally mounted rotatable drum coacts with non-rotating magnets disposed in the drum in a manner to convey magnetic constituents in contact with the drum surface to an outlet for magnetic concentrate, and in which method pulp which is depleted of magnetic constituents is separated as waste at a region remote from the concentrate outlet in a direction opposite to the direction in which the drum rotates. Additionally, pulp is delivered to the separator so as to bring the pulp into contact with the drum at or close to the highest level of the drum; water is delivered to the separator in the vicinity of the concentrate outlet such that water will flow in contact with the pulp constituents that accompany drum rotation; and water is removed from the drum together with the waste. A wet-magnetic separator is also set forth.

10 Claims, 1 Drawing Sheet

METHOD OF SEPARATING PULP CONTAINING MAGNETIC CONSTITUENTS IN A WET-MAGNETIC, LOW-INTENSITY CONCURRENT SEPARATOR AND APPARATUS THEREFOR

BACKGROUND OF THE INVENTION

1. Field of The Invention

The present invention relates to a method which pertains to the separation of pulp that contains magnetic constituents in a wet-magnetic, low-intensity separator of he concurrent kind, in which a cylindrical, horizontally mounted rotatable drum coacts with non-rotating magnets disposed in said drum in a manner to convey magnetic constituents in contact with the drum surface to a magnetic concentrate outlet, and in which method pulp which is depleted of magnetic constituents is separated as waste at a region remote from the concentrate outlet in a direction opposite to the direction of drum rotation.

The invention also relates to a wet-magnetic separator for carrying out the method.

2. Description of the Related Art

The magnetic separation of ores is an old technique in the art. Such methods include both wet-magnetic and dry-magnetic processes. With regard to the strength of the magnetic fields, it is possible to divide the wet-magnetic processes into low intensity processes, WLIMS (Wet Low Intensity Magnetic Separation) and high intensity methods, HGMF (High Gradient Magnetic Field). There is also an intermediate process DMHG (Dense Media High Gradient) in respect of extremely fine material of low magnetic concentration, such as tailings derived from flotation enrichment processes for instance. All of the magnetic separators and separation processes known hitherto are found described in general textbooks available in the field of mineral dressing, and in brochures produced by apparatus manufacturers, such as Sala International for instance.

Of all of the magnetic separation methods known at present, the wet-magnetic low intensity separation method is the one most generally used, whereas the other methods are of a more particular kind, for instance intended for application with suspensions having low concentrations of magnetic material or containing only weakly magnetic or paramagnetic material, or intended for dry ground material.

The wet-magnetic, low intensity methods are effected in a rotating drum in which there is stationarily mounted a magnetic yoke which is comprised either of permanent magnets or of electromagnets and which is lowered partially into a tank containing the pulp slurry. As the drum rotates, the magnetic yoke generates in the tank a magnetic field which is effective in transporting magnetic constituents of slurried ore (pulp) or the like fed to the tank from one side of the tank to the other, while non-magnetic constituents are removed from the tank somewhere therebetween. The whole of the upper part of the drum, i.e. that part which does not extend down into the tank, is thus not used in the separation process. The pulp level in the tank is normally about 25–50 mm above the lowest part of the drum. In the case of dry magnetic separation processes effected in a so called Mörtsell separator using a drum enclosed in a chamber, the upper part of the drum is also used in the separation process, since the dry material to be separated is delivered close to the highest point of the drum, the magnetic material being separated close to the lowest point of the drum. A separator of this kind is described, for instance, in DE-C-750727 and functions to separate iron filings and chips from waste sand, wherein adhering concentrate is removed from the drum by spraying with water.

The separation result is influenced by several factors. in this case, by separation result is meant the yields of magnetic material in the concentrate extracted or the concentration of non-magnetic material in the magnetic concentrate. The most important of these factors is the strength and configuration of the magnetic field, the type of tank used, the diameter of the drum and the speed at which the drum is rotated.

The magnetic field is normally divided into several zones, for instance a pick-up zone, a transport zone and a dewatering zone, and extends from 110° to 120° around the drum circumference. A magnetic field of about 500–1000 gauss is suitable for the separation of magnetite.

The separation result is also influenced by the diameter of the drum, wherein a larger diameter tends to provide higher yields and greater capacity. Normal drum sizes range from 600 mm to 1200 mm.

One known method of improving the separation result includes a washing stage in which water is delivered adjacent the concentrate outlet and the water is allowed to flow into contact with the concentrate on the drum surface over a shorter or longer path. Such methods are described, for instance, in SE-C-38777 and U.S. Pat. No. 2,945,590. Publications SE-C-198980 and SE-C-227295 describe similar methods, although in this case the washing stage is placed above the concentrate outlet. U.S. Pat. No. 2,698,685 describes another method, in which water is delivered in the form of jets which function to form a type of barrier through which non-magnetic material is prevented from passing. The effect produced is similar to the effects produced by the aforesaid washing methods.

The types of tanks used are concurrent tanks, countercurrent tanks and counter-rotation tanks. Countercurrent, or contraflow, is often more effective than concurrent, but does not enable large particles (>0.8 mm) to be handled effectively, whereas the concurrent technique is able to handle particle sizes of up to 6 mm. Counter-rotational separators are suitable for applications where yield is more important than quality.

All of the result-influencing factors known at present, however, have natural limitations and despite the application of optimally chosen parameters, optimal separators and careful trimming of the apparatus used, the yields obtained or the concentrations of desired materials in the products are far from being complete. For example, the wet-magnetic separators are often used in multi-stage systems in which several separator drums are arranged in series. In this case, the separation result is a function of the number of series connected drums.

SUMMARY OF THE INVENTION

It has now been found surprisingly possible, in accordance with the invention, to effectively enhance the quality of the magnetic concentrations obtained when separating pulp in wet-magnetic, low-intensity separators of the concurrent type, enabling, among other things, the number of stages to be reduced and less water to be consumed, without impairing the yields. The invention is characterized in this regard by a specific combination of method steps and apparatus features, as set forth in the following claims.

DESCRIPTION OF THE PREFERRED EMBODIMENTS

Figure 1:
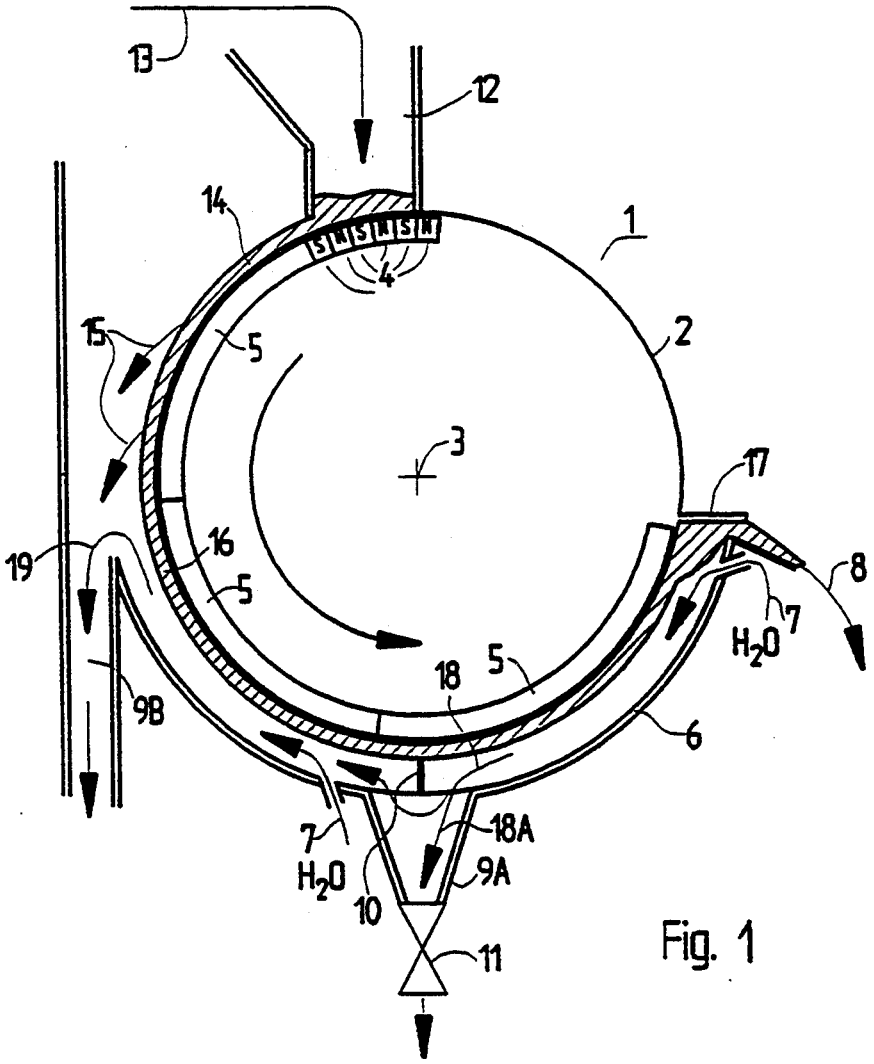
FIG. 1 is a schematic illustration of a preferred embodiment of the invention.

Thus, according to the invention, pulp is delivered to the separator so as to be brought into contact with the drum at or close to the highest level of the drum, while, at the same time, washing water is delivered to the separator immediately upstream of the concentrate outlet. The water delivered to the separator is caused to flow in contact with those pulp constituents which are transported in the direction of drum rotation until it is removed together with the waste.

The method is carried out in what is referred to herebelow as a three-chamber separator, where part of the drum located above the tank and the whole of that part of the drum which depends into the tank are used, wherein that part of the tank in which separation is carried out is divided into two zones. Thus, in the three-chamber separator , the part of the drum which is located above the tank is also utilized, this part forming a third zone, in addition to the two drum parts earlier used for wet-magnetic separation purposes.

Thus, according to the present invention, the pulp is brought into contact with the drum at or close to the highest level of the drum. The waste is herewith separated in two separate outlets, of which one is particularly intended for coarser waste and is located in the region of the lowest level of the drum, while the other outlet is intended for the major part of the waste and is located at a higher level beneath half the drum height. According to the invention, it is suitable to deliver additional water to the vicinity of the waste outlet located at the lowest drum level in a direction counter to the direction of drum rotation, i.e. upstream of the bottom outlet as seen in the direction of drum rotation, so as to compensate for the water that is removed from the drum through said lowest output. In order to ensure that waste will also flow out through the highest of the two waste outlets, the flow of waste through the lowermost outlet can be controlled or throttled in some suitable way. Non-magnetic solids are preferably prevented mechanically from passing between the two lowermost zones on either side of the bottom outlet against drum rotation, for instance by mounting a rib or baffle on the tank bottom in the direction of the long axis of the drum.

Thus, in principle, the invention resides in a combination of a three-chamber construction of a wet-magnetic separator and the delivery of additional water at the concentrate outlet and causing this additional water to pass into contact with the concentrate in a countercurrent direction. Although a separator of a three-chamber design will alone provide a large capacity, it will not improve the separation result, whereas the delivery of additional washing water on its own will slightly improve separation but will not increase capacity. The inventive combination thus affords an unexpected synergistic effect, primarily with regard to the separation result, although productivity has also been found to be very high.

The inventive method and apparatus will now be described in more detail with reference to an exemplifying embodiment thereof and also with reference to the accompanying drawing wherein FIG. 1 illustrates schematically a preferred embodiment of the invention.

Shown in the drawing is a magnetic separator 1 comprising a cylindrical drum 2 which when in operation rotates in the arrowed direction. The drum 2 has a horizontally mounted rotation axis 3 which extends perpendicular to the plane of the drawing and which is shown as a cross. Arranged within the drum 2 are a number of magnets 4 of which only some are shown and are alternately referenced N and S. In the illustrated embodiment, the magnets 4 are disposed in three separate magnetic yokes 5 which has a pole pitch of about 45–150 mm, in accordance with the conventional magnetic yokes of the Mörtsell separators. The drum 2 is partially lowered into a tank 6 equipped with water delivery devices 7 over essentially the full length of the drum 2. The tank 6 is also provided with magnetic concentrate outlets 8 and separation waste outlets 9A, B. Mounted on the bottom of the tank 6 is a rib 10 which extends in the longitudinal direction of the drum and which prevents the passage of solid non-magnetic material. The waste outlet 9A is fitted with a control valve 11 which controls the flow of material through the outlet 9A. The material to be separated is delivered to the tank by a feeder 12.

When the illustrated exemplifying embodiment of the magnetic separator 1 is in operation, an aqueous pulp suspension 13 containing magnetic constituents is supplied through the feeder 12 on the upper parts of the drum 2. In this case, the pulp 13 is partially transported further on the surface of the drum 2 in the form of a material layer 14, and is partially slung from the drum surface, as illustrated by the arrows 15, due to the tendency of the individual pulp constituents to be attracted to the magnetic field generated by the magnetic yoke 5 and the magnets 4. Thus, more magnetic material will follow the surface of the drum as it rotates down into and through the tank 6, while the majority of the non-magnetic material 15 will pass directly down into the waste outlet 9B, unless being captured earlier by the magnetic material layer and retained in said layer. The magnetic layer of material 16 will pass through the tank 6 in contact with the contraflow of water in the tank, this contraflow being generated through the water delivery devices 7 provided on the bottom of the tank 2 adjacent the waste outlet 9A and the upper part adjacent the magnetic material outlet 8. The magnetic part 16 of the pulp which accompanies the drum surface as it rotates will undergo an intensive washing process by the flowing water, among other things due to splitting of the material layer 16 caused by relayering at the pole turns, wherein non-magnetic material which has been entrained and incorporated in the material layer is able to accompany the flow of water out through the waste outlet 9, while the magnetic constituents in the pulp are again attracted by the magnetic field and transported in the direction of drum rotation to the magnetic material outlet 8. The nearer the outlet 8, the less non-magnetic material present in the material layer 16. A highly enriched magnetic concentrate can thus be removed from the drum 2 with the aid of a scraper device 17, while non-magnetic waste is transported through the waste outlets 9A and 9B together with the flow of water, as illustrated by an arrow 18. The flow of waste 18A through the outlet 9A is comprised essentially of coarse material and is controlled by the valve 11 in a manner to ensure that a sufficiently large flow of waste that contains the major part of the nonmagnetic material will exit through the higher located waste outlet 9B, as illustrated by an arrow 19.

EXAMPLE

A number of comparison separation tests have been carried out in a conventional magnetic separator (concurrent), with and without a washing water addition and in a three-chamber construction in which washing was effected in accordance with the invention. The amount of silica remaining in the magnetic concentrate obtained was determined in order to obtain an estimate of the separation effect achieved. The tests were carried out with pulp suspensions of different concentrations, more specifically with pulp having a water content of between 50 and 80 percent by weight, i.e. pulp having a solid mass percentage of from 50% to 20%.

The results are set forth in the following table, in the form of the mean values of several tests.

| | % $SiO_2$ in concentrate | | |
|---|---|---|---|
| Pulp % $H_2O$ | Conv. cell without wash | Conv. cell with wash | Three-chamber cell according to invention |
| 50 | 2.50 | 2.10 | 1.55 |
| 55 | 2.45 | 2.05 | 1.45 |
| 60 | 2.40 | 2.00 | 1.40 |
| 65 | 2.32 | 1.97 | 1.35 |
| 70 | 2.27 | 1.94 | 1.25 |
| 75 | 2.25 | 1.92 | 1.15 |
| 80 | 2.21 | 1.90 | 1.10 |

The results show that separation of magnetic material and non-magnetic material ($SiO_2$) over all normal pulp compositions is much better when effected in the inventive separator and by the inventive method than when effected in conventional wet-magnetic separators, even in those which include an additional washing stage. The separation effect achieved with the inventive three-chamber separator is progressively improved with the amount of water present in the pulp.

We claim:

1. A method of separating pulp containing magnetic constituents and non-magnetic constituents in a wet-magnetic, low-intensity separator of the concurrent type comprising a cylindrical, horizontally mounted, rotatable drum co-acting with non-rotating magnets mounted within the drum so as to transport magnetic constituents in contact with the drum surface to a magnetic concentrate outlet, said separator further comprising a waste outlet for pulp depleted of magnetic constituents, said method comprising delivering the pulp to said separator so as to bring the pulp into contact with the drum at or close to the highest level of said drum; delivering water to the separator in the vicinity of the magnetic concentrate outlet such that said water will flow in contact with the pulp constituents that accompany drum rotation and thereby cause non-magnetic constituents thereof to accompany said water flow counter to the drum rotation to said waste outlet; and removing waste comprised of non-magnetic constituents and water from said separator through said waste outlet.

2. The method of claim 1 wherein the waste is removed in two separate outlets, one of which is located at the region of the lowest level of the drum and another of which is located at a higher level beneath the drum midway point.

3. The method of claim 2 wherein additional water is delivered to the vicinity of the waste outlet located at the region of the lowest level of the drum in a direction counter to the drum rotation.

4. The method of claim 3 wherein the flow through the waste outlet located at the region of the lowest level of the drum is controlled so that a major part of the waste will exit through the another waste outlet located at a higher level beneath the drum midway point.

5. The method of claim 4 wherein non-magnetic constituents are prevented from accompanying the flow of water beyond the waste outlet located at the region of the lowest level of the drum.

6. The method of claim 2 wherein the flow through the waste outlet located at the region of the lowest level of the drum is controlled so that a major part of the waste will exit through the another waste outlet located at a higher level beneath the drum midway point.

7. The method of claim 2 wherein non-magnetic material constituents are prevented from accompanying the flow of water beyond the waste outlet located at the region of the lowest level of the drum.

8. A wet-magnetic separator for separating pulp containing magnetic constituents comprising a cylindrical, horizontally mounted, rotatable drum, magnets mounted inwardly of the drum periphery, a magnetic concentrate outlet, a waste outlet located in the bottom of the separator, means for delivering pulp to the highest level of the drum, water inlets arranged substantially along the full length of the drum in the vicinity of the magnetic concentrate outlet so that water will flow in contact with the pulp constituents that accompany drum rotation and thereby cause non-magnetic constituents thereof to accompany said water flow counter to the drum rotation to said waste outlet, and wherein the magnets are mounted with a pole pitch of 45 to 150 mm to at least a part of the total extension of the magnetic yoke formed by said magnets.

9. The wet-magnetic separator of claim 8 wherein the separator further comprises a waste outlet on a level between the midway point of the drum and the waste outlet located in the bottom of the separator.

10. The wet-magnetic separator of claim 9 wherein the separator further comprises a further water inlet adjacent the bottom of the drum arranged to provide water in a direction counter to the rotation of the drum.

* * * * *

UNITED STATES PATENT AND TRADEMARK OFFICE

CERTIFICATE OF CORRECTION

PATENT NO. : 5,377,845

DATED : January 3, 1995

INVENTOR(S) : Ilkka Olvi HAMEN et al.

It is certified that error appears in the above-indentified patent and that said Letters Patent is hereby corrected as shown below:

Claim 7, column 6, line 29, delete "ma-".

line 30, delete "terial".

Signed and Sealed this

Fifth Day of September, 1995

*Attest:*

*Attesting Officer*

Bruce Lehman

BRUCE LEHMAN

*Commissioner of Patents and Trademarks*